US006339293B1

(12) United States Patent
Kimiya et al.

(10) Patent No.: US 6,339,293 B1
(45) Date of Patent: Jan. 15, 2002

(54) CATHODERAY TUBE

(75) Inventors: Junichi Kimiya; Takashi Awano, both of Fukaya; Shigeru Sugawara, Saitama-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/423,601

(22) PCT Filed: Mar. 12, 1999

(86) PCT No.: PCT/JP99/01219

§ 371 Date: Nov. 12, 1999

§ 102(e) Date: Nov. 12, 1999

(87) PCT Pub. No.: WO99/46794

PCT Pub. Date: Sep. 16, 1999

(30) Foreign Application Priority Data

Mar. 13, 1998 (JP) ..... 10-062627

(51) Int. Cl.[7] ..... H01J 29/46

(52) U.S. Cl. ..... 315/15; 315/368.15; 315/368.16; 313/421; 313/440; 313/441

(58) Field of Search ..... 315/15, 368.15, 315/368.16; 313/421, 440, 441

(56) References Cited

U.S. PATENT DOCUMENTS 5,694,004 A * 12/1997 Kimiya et al. ..... 315/15
6,016,030 A * 1/2000 Amano et al. ..... 313/414
6,225,766 B1 * 5/2001 Ono et al. ..... 315/15

FOREIGN PATENT DOCUMENTS

JP 57-15463 3/1982 ..... H01J/29/50
JP 4-147545 A 5/1992 ..... H01J/29/50
JP 6-223738 A 8/1994 ..... H01J/29/50
JP 7-220648 A 8/1995 ..... H01J/29/50
JP 2561944 9/1996 ..... H01J/29/50
JP 10-162752 A 6/1998 ..... H01J/29/48
JP 10-172465 A 6/1998 ..... H01J/29/50
JP 11-120934 A 4/1999 ..... H01J/29/50

* cited by examiner

*Primary Examiner*—Don Wong
*Assistant Examiner*—Jimmy T. Vu
(74) *Attorney, Agent, or Firm*—Oblon, Spivak, McClelland, Maier & Neustadt, P.C.

(57) ABSTRACT

An electron gun assembly of a cathode ray tube has a main electron lens section comprising at least four electrodes, provided in a sequence of first, second, third and fourth grids, a middle first voltage is applied to the first grid, and an anode voltage is applied to the fourth grid. The adjacent second grid and third grid are connected by a resistor, and second and third voltages of substantially the same potential, corresponding to voltages higher than the middle first voltage and lower than the anode voltage, are applied thereto. An asymmetrical lens is provided between the adjacent second grid and the third grid second lens region, and a voltage which changes in synchronism with the deflecting magnetic field is applied to the first grid. Therefore, it is possible to provide a cathode ray tube wherein a phenomenon of sideways deviation of an electron beam at the peripheral region of a screen caused by lens magnification difference in the horizontal and vertical directions is reduced, and which has good image characteristics in all regions of the screen.

10 Claims, 10 Drawing Sheets

CATHODERAY TUBE

TECHNICAL FIELD

This invention relates to a cathode-ray tube, and more particularly to a cathode-ray tube incorporating an electron gun assembly which compensates for dynamic astigmatism.

BACKGROUND ART

Generally, a color cathode ray art tube has an envelope as shown on FIG. 1. The envelope comprises a panel 1 and a funnel 2 joined to the panel 1. A phosphorous screen 3 (target) is provided on the inner surface of the panel 1. the screen 3 comprises striped or dot-like three-color phosphor layers for generating blue, green, and red light rays. A shadow mask 4 is provided in the funnel 2 and faces the phosphor screen 3. The shadow mask 4 has a large number of aperatures. The funnel 2 has a neck 5, in which an electron gun assembly 7 is provided. A deflection yoke 8 is mounted on the neck 5. The electron gun assembly 7 emits three electron beams 6B, 6G, and 6R. The yoke 8 generates a horizontal magnectic field and a vertical magnetic field. These magnetic fields deflect the electron beams 6B, 6G and 6R in horizontal direction and vertical direction, respectively. The electron beams 6B, 6G and 6R pass through the shadow mask 4, scanning the phosphor screen 3 in horizontal and vertical directions. A color image is thereby displayed on the panel 1.

A type of a color cathode-ray tube, known as a self-convergence, in-line-type color cathode-ray tube, is used widely. This cathode-ray tube comprises an in-line type gun assembly having three electron guns 7 which are arranged side by side in the same horizontal plane. The guns 7 emit a center electron beam 6B and side electron beams 6G and 6R. The side beam 6G is on one side of the center beam 6B, and the side beam 6R on the other side thereof. The three beams 6B, 6G and 6R travel in a horizontal plane. The electron gun assembly has a main lens section, in which a low-potential grid and a high-potential grid are arranged. Each grid has three beam-guiding holes. The center beam-guiding hole of the high-potential grid is concentric to that of the low-potential grid. By contrast, the side beam-guiding holes of the high-potential grid are eccentric to those of the low-potential grid. The beams 6B, 6B and 6R passing through the beam-guiding holes is converged on the center region of the phosphor screen 3. The horizontal magnetic field generated by the yoke 8 is shaped like a pincushion, whereas the vertical magnetic field generated by the yoke 8 is shaped like a barrel. The electron beams 6B, 6G and 6R deflected by the pincushion-shaped and barrel-shaped magnetic fields are converged at any region of the phosphor screen 3.

In the self-convergence in-line-type color cathode-ray tube, an electron beam is influenced by astigmatism after passing an uneven magnetic field. For instance, the beam is distorted as shown in FIG. 2A. The beam spot, which the beam forms on a peripheral region of the phosphor screen, is inevitably distorted as shown in FIG. 2B. The electron beam is also affected by deflection aberration, which occurs when the electron beam is focused excessively in the vertical direction, generating a large halo 13 extending in vertical direction as shown in FIG. 2B. The larger the cathode-ray tube, the greater the deflection aberration. The larger the angle by which the beams are deflected, the lower the image resolution at the peripheral regions of the phosphor screen.

Means for preventing the image resolution from lowering due to deflection aberration is disclosed in Jpn. Pat. Appln. KOKAI Publication No. 61-99249, Jpn. Pat. Appln. KOKAI Publication No. 61-250934, and further, in Jpn. Pat. Appln. KOKAI Publication No. 2-72546. As shown in FIG. 3, the electron gun assemblies comprise first grid G1 to fifth grid G5, and an electron beam generator GE, a four-pole lens QL, and a final focusing lens EL, which are arranged along the axes of electron beams. As shown in FIGS. 4A and 4B, the multiple lens, for example, four-pole lens QL has three electron beam guide holes 14*a,* 14*b,* and 14*c* in one end of the third grid G3 and three electron beam guide holes 15*a,* 15*b* and 15*c* in that end of the fourth grid G4. The multiple lens, for example, four-pole lens QL and the final focusing lens EL change in synchronism with the magnetic field of the deflecting yoke. This makes it possible to prevent the electron beams from being distorted at the peripheral regions of the screen, despite of the deflection aberration of the deflecting magnetic field. Thus, the beams can form undistorted spots on any region of the screen.

If such a mean is used, however, a problem arises when the astigmatism caused by the deflecting yoke is very strong at the peripheral region of the screen, though the halo extending in a line perpendicular to the beam spot. Namely, it is not possible to eliminate the sideways expansion of the electron beam spot.

This problem with the conventional electron gun assembly will be explained with reference to FIG. 5. FIG. 5 illustrates the lens operation performed in the conventional electron gun assembly. In FIG. 5, the solid lines represent the track of an electron beam, showing how the lens focuses the beam at the center of the phosphor screen. The broken lines represent the track of the electron beam, illustrating how the lens focuses the beam at a peripheral region of the screen.

As shown in FIG. 5, the multiple lens, for example, four-pole lens QL1 is provided on the cathode side of the main electron lens (EL). To direct the electron beam to the center of the screen, only the main electron lens EL indicated by the solid lines focuses the electron beam. To deflect the electron beam to the peripheral region of the screen, a deflecting lens DYL is formed by the deflecting magnetic field represented by the broken lines.

Generally, a self-convergence-type deflecting magnetic field is generated in a color cathode-ray tube. The force for focusing the beam in the horizontal direction H does not change, and the deflecting lens DYL focuses the beam in the vertical direction V only.

FIG. 5 does not show the action of the magnetic field for deflecting the beam in the horizontal direction, for the purpose of illustrating only the problem caused by the self-convergence, deflecting magnetic field.

When the deflecting lens DYL is formed, that is, when the embodiment is focused at a peripheral region of the screen, the force of the electron lens EL is decreased as shown by the broken lines in FIG. 5. To compensate for the force of the lens EL for focusing the beam in the horizontal direction H, the multiple lens QL1 is formed. As a result, the electron beam travels along the track shown by the broken lines and is focused at the peripheral region of the screen. The main plane of the lens for focusing the electron beam in the horizontal direction H is at position A when the electron beam is directed at the center of the screen. (The main plane is the virtual center of the lens, or a point at which the track of the emitted beam crosses that of the beam radiated onto the screen.) When the electron beam is deflected to the peripheral region of the screen, forming a multiple lens, the main plane extending in the horizontal direction H moves to position B and lies between the main electron lens EL and the multiple lens QL1. Further, the main plane extending in the vertical direction V moves from the position A to position C. Therefore, the main plane extending in the horizontal direction H moves back from the position A to the position B, decreasing magnification. Furthermore, the main plane extending in the vertical direction V moves forward from the position A to the position C, increasing the magnification. Consequently, a difference emerges between the magnification in the horizontal direction and the magnification in the vertical direction. The electron beam spot formed in any peripheral region of the screen inevitably expands sideways, or in the horizontal direction.

DISCLOSURE OF INVENTION

It is an object of the present invention to provide a color cathode-ray tube in which the sideways expansion of a beam spot is eliminated or reduced, despite of the difference in magnification between the horizontal and vertical lenses, and which can therefore form undistorted beam spots in all regions of the screen.

According to a first aspect of this invention, there is provided a cathode-ray tube comprising:

an electron beam formation portion for forming and emitting electron beam;

an electron gun assembly having a main electron lens section for accelerating and focusing the electron beam; and a deflecting yoke for generating a deflecting magnetic field for deflect-scanning the electron beam emitted from this electron gun assembly in the horizontal and vertical directions on a screen; wherein the main electron lens section comprises at least four electrodes provided in the order of first, second, third and fourth grids, a middle first voltage being applied to the first grid, an anode voltage being applied to the fourth grid, the adjacent second grid and the third grid being connected by a resistor, second and third voltages which are higher than the first voltage and lower than the anode voltage, being applied to the second and third grids; a first lens region being formed the first grid and the second grid; a third lens region being formed between the third grid and the fourth grid; a second lens region being formed between the second grid and the third grid; and an asymmetrical lens being provided in this second lens region.

Furthermore, according to this invention, there is provided a cathode ray tube wherein the lens power of the first, second and third lens regions changes in synchronism with the deflecting magnetic field.

Moreover, according to this invention, there is provided a cathode ray tube characterized in that, as the electron beam is directed from the center portion of the screen toward the peripheral region of the screen in synchronism with the deflecting magnetic field, the first and third lens regions have a lens power which weakens in the horizontal and the vertical directions, and by contrast, the asymmetrical lens provided in the second lens region has a lens power of relatively focusing in the horizontal direction and diverging in the vertical direction. That is, when the electron beam is in the center of the screen, the electron gun assembly according to an embodiment of the present invention has a diverging action in the horizontal direction and a focusing action in the vertical direction, and when the electron beam is at the peripheral region of the screen, the electron gun assembly has a focusing action in the horizontal direction and a diverging action in the vertical direction.

Furthermore, according to this invention, there is provide a cathode ray tube is wherein a voltage which changes in synchronism with the deflecting magnetic field is applied to the first grid, and as the electron beam is directed from the center portion of the screen toward the peripheral region of the screen, in synchronism with the deflecting magnetic field, the first and third lens regions have a lens power which weakens in the horizontal and the vertical directions, and by contrast, the asymmetrical lens provided in the second lens region has a lens power of relatively focusing in the horizontal direction and diverging in the vertical direction, thereby canceling overall changes of the lens power in the horizontal direction of the first and third lens regions.

Furthermore, according to this invention there is provided a cathode ray tube wherein, by applying an AC voltage which changes in synchronism with the deflecting magnetic field to the first grid, the AC voltage components thereof are applied via static capacitances between the first grid, the second grid, the third grid and the fourth grid to the second grid and the third grid, thereby changing the lens power of the first, second and third lens regions.

Furthermore, according to this invention there is provided a cathode ray tube wherein a voltage which changes in synchronism with the deflecting magnetic field is applied to the first grid, the second grid is electrically connected to a fifth grid, and the fifth grid is provided adjacent to the first or another grid to which a voltage which changes in synchronism with the deflecting magnetic field is applied.

FIG. 6 shows the electron beam track and lens power of the above constitution. Here, the solid line represents the electron beam track and lens power when the electron beam is focused in the center of the screen, and the broken lines represents the electron beam track and lens power when the electron beam is focused at the peripheral region of the screen. In the electron gun assembly according to the present invention as shown in FIG. 6, the multiple lens, for example, four-pole lens (QL1) is positioned substantially near the center of the main electron lens (EL), and when the electron beam is directed at the center of the screen, this multiple lens (QL1) has a lens power of focusing in the vertical direction and diverging in the horizontal direction, and when the electron beam is deflected toward the peripheral region of the screen, it has a lens power of focusing in the horizontal direction and diverging in the vertical direction, as shown in the diagram by the broken line. Furthermore, when the electron beam is directed at the center of the screen, since the multiple lens (QL1) functions as a diverging lens in the horizontal direction and as a focusing lens in the vertical direction, the main electron lens (EL) is a substantially cylindrical lens of strong focusing strength in the horizontal direction, so as to compensate the horizontal and vertical focus difference. Then, this main electron lens (EL) becomes weaker over its entirety when the electron beam is deflected to the peripheral region of the screen, and in the horizontal direction, it operates so as to cancel the lens operation of the preceding multiple lens (QL1). At this time, the track of the electron beam in the vertical direction is like that shown by the broken line, but the track of the electron beam in the horizontal direction is not different from when the electron beam is focused in the center of the screen, since the position of the multiple lens (QL1) roughly matches the position of the main electron lens. Therefore, the lens main plane (hypothetically the lens center; the cross point between the emitted beam track and the beam track radiated onto the screen) which focuses the electron beam in the horizontal direction (H) does not change whether the electron beam is in the center of the screen or deflected to the peripheral region of the screen (main plane A'=main plane B'), and in the vertical direction, although the main plane position moves forward by the amount generated by the DY lens, in comparison with the conventional electron gun assembly, with the conventional electron gun assembly, the multiple lens (QL1) is positioned closer to the cathode side than the main electron lens, and the multiple lens (QL1) generates divergence in the vertical direction, and the electron beam track passes a position distant from the core axis of the main electron lens (EL), and the main plane position C was moved forward by that amount, but in the electron gun assembly of the present invention, since the multiple lens (QL) is provided inside the main electron lens (EL), the track of the electron beam entering the main electron lens (EL) is unchanged, and consequently the shift position (main plane C') of the main plane in the vertical direction is further forward (on the cathode side) by that amount than the main plane position C of the conventional electron gun assembly, the magnification in the vertical direction being no greater than the conventional electron gun assembly, and the vertical diameter of the electron beam at the peripheral region of the screen does not greatly deteriorate. Therefore, in comparison with the conventional electron gun assembly, in the electron gun assembly of the present invention, the main plane position has little deviation in the horizontal and vertical directions at the peripheral region of the screen, and the phenomenon of sideways deviation of the electron beam at the peripheral region of the screen is reduced by that amount, achieving a more rounded electron beam. Consequently, by using the electron gun assembly according to the present invention, it is possible to obtain a cathode ray tube with no sideways deviation at the peripheral region of the screen and better resolution in all regions of the screen. Moreover, the second grid and the third grid are connected at a resistor provided near the electron gun assembly, and since the second grid and the third grid are provided between the first grid, to which an AC voltage in synchronism with the deflecting magnetic field is applied, and the fourth grid, to which a DC anode voltage is applied, the components of the AC voltage applied to the first grid can be applied to the second grid and the third grid via the static capacitances between the first grid, the second grid, the third grid and the fourth grid, and the multiple lens formed between these electrodes can be operated using the potential difference between the second grid and the third grid generated at this time. Furthermore, the resistor provided near the electron gun assembly applies a voltage, obtained by resistance-dividing the anode voltage Eb applied to the fourth grid, to the second grid and the third grid, and therefore it is not necessary to apply an extra voltage from outside the cathode ray tube, making it easy to realize a high-quality cathode ray tube as shown above.

BEST MODE OF CARRYING OUT THE INVENTION

The electron gun assemblies incorporated in cathode-ray tubes according to an embodiment of the present invention will be described with reference to the accompanying drawings.

Figure 7A:
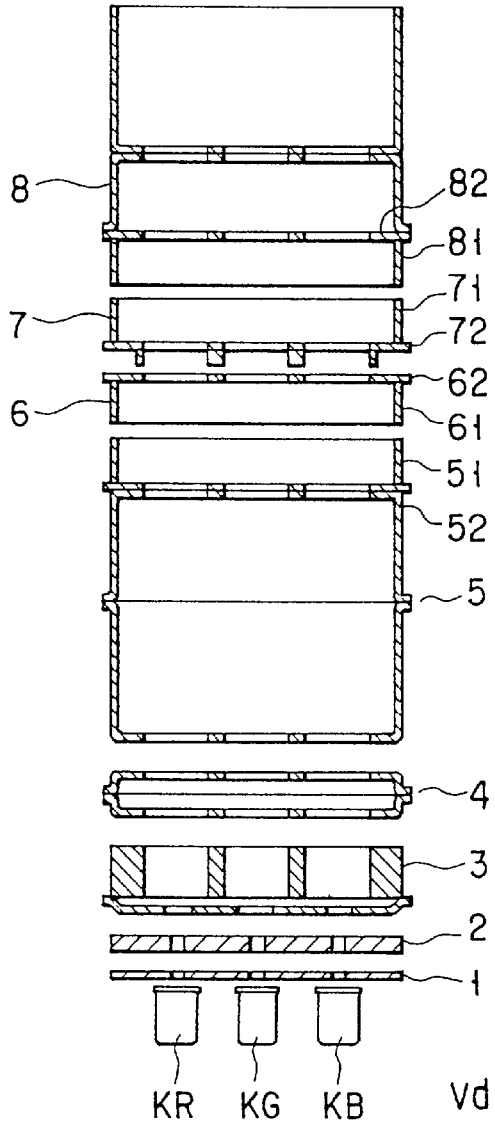
FIGS. 7A and 7B are cross-sectional views of the electron gun assembly incorporated in the cathode-ray tube according to the embodiment of this invention.
Figure 7B:
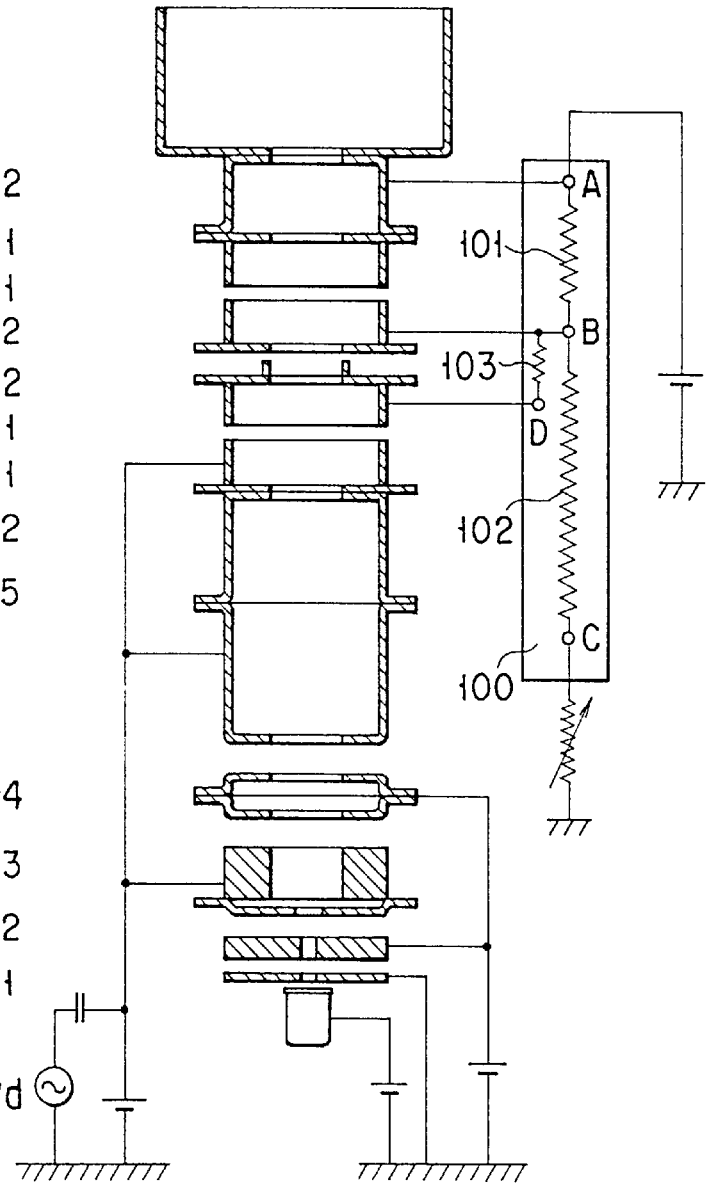

FIGS. 7A and 7B are cross-sectional views showing the electron gun assembly incorporated in a cathode-ray tube according to the first embodiment of the present invention. As FIG. 7A shows, three cathodes KB, KG and KR, first to eighth grids 1 to 8, and a convergence cup are arranged in the order mentioned are secured to an insulated support (not shown). The cathodes KB, KG and KR contain a heaters (not shown) each, for generating an electron beam.

The first grid 1 is a thin electrode having three electron beam guide holes of a small diameter. The second grid 2 is a thin electrode having three electron beam guide holes of a small diameter. The third grid 3 comprises a thick electrode and a cup-top electrode combined with the thick electrode. The third grid 3 has three electron beam guide holes made in the side facing the second grid 2. These holes are slightly larger than the electron beam guide holes of the second grid 2. The fourth grid 4 also has three electron beam guide holes of a large diameter. The fourth grid 4 G4 comprises two cup-like electrodes connected together at their open ends. Each cup-shaped electrode has three electron beam guide holes of a large diameter.

Figure 8A:
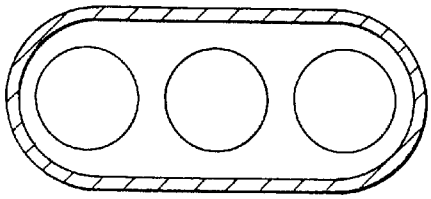
FIGS. 8A to 8D are plan views showing the shapes of the electrodes used in the electron gun assembly shown in FIGS. 7A and 7B.

The fifth grid 5 comprises two long cup-like electrodes, a cylindrical electrode 51, and a plate-like electrode 52. The long cup-like electrodes are arranged along the path of the electron beams and fastened each other at their open ends. The cylindrical electrode 51 is fastened at its closed end to the long cup-like electrodes, with the plate-like electrode 52 interposed between them. The closed ends of the cylindrical electrode 51 and cup-like electrodes have three electron beam guide holes in common. The cylindrical electrode 51 looks as shown in FIG. 8A as viewed from the sixth grid 6.

Figure 8C:
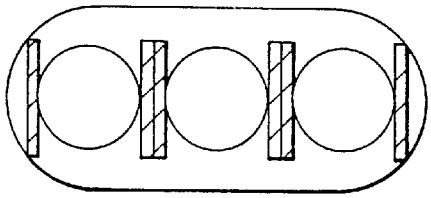
Figure 8B:
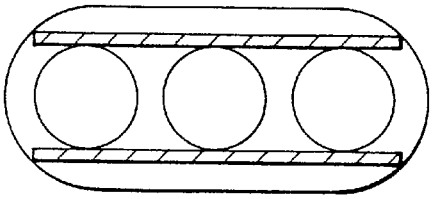
Figure 8D:
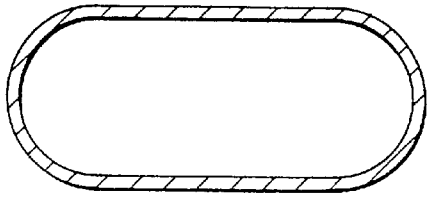

The sixth grid 6 comprises a cylindrical electrode 61 and plate-like electrode 62. The electrode 61 has one opening for guiding three electron beam, as shown in FIG. 8D. The plate-like electrode 62 has three electron beam guide holes. Peak-shaped electrodes are formed integral with the electrode 62, on that side of the plate-like electrode 62 which oppose the seventh grid 7. As shown in FIG. 8B, the peak-shaped electrodes are spaced apart, located on the opposite sides of the array of electron beam guiding holes, respectively.

The seventh grid 7 comprises a cylindrical electrode 71 and a plate-like electrode 72. Peak-shaped electrodes are formed integral with the plate-like electrode 72, provided on that side which opposes the sixth grid 6. As shown in FIG. 8C, the peak-shaped electrodes are spaced apart, with the electron beam guide holes located between them. The cylindrical electrode 71 has one opening for guiding three electron beams. A powerful multiple lens, for example, four-pole lens is formed between the sixth grid 6 and the seventh grid 7.

The eighth grid 8 comprises a cylindrical electrode 81 and a plate-like electrode 82. The cylindrical electrode 81 has an opening at one end and closed by the plate-like electrode 82 at the other end. The open end serves to guide three electron beams, as can be understood from FIG. 8D. The plate-like electrode 82 has three electron beam guide holes. The eighth grid 8 looks as shown in FIG. 8A, when viewed from the seventh grid 7.

In operation, the first grid 1 is grounded, and a voltage Ek of about 100 to 150 v is applied to the three cathodes KB, KG and KR. A voltage Ec2 of about 600 to 800 v is applied to the second grid 2 and the fourth grid 4. A focusing voltage Vf+Vd of about 6 to 9 Kv, which changes in synchronism with the deflecting magnetic field, is applied to the third grid 3 and the fifth grid 5. An anode voltage Eb of about 25 to 30 Kv is applied to the eighth grid 8. A resistor 100 provided near the electron gun assembly applies a voltage to the seventh grid 7, this voltage having a value between the voltages applied to the fifth grid 5 and the eighth grid 8. A voltage is applied from the seventh grid 7 via a resistor 103 to the sixth grid 6. The middle electrodes (i.e., sixth and seventh grids), provided between the fifth and eighth grids 5 and 8 form a lens system having an expanded electric field. The lens system serves as a lens having a long focal length of a large diameter. Therefore, the lens system focuses electron beams, which form small beam spots on the screen.

Figure 9:
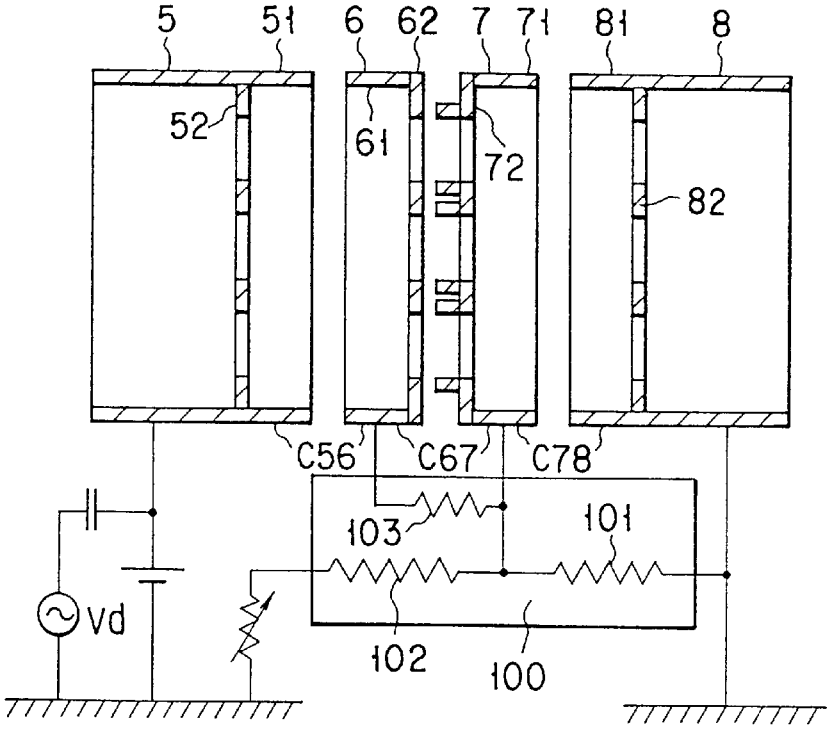
FIG. 9 shows in detail the main lens section of the electron gun assembly shown in FIGS. 7A and 7B, and a circuit including the electrodes used in the main lens section.
Figure 10:
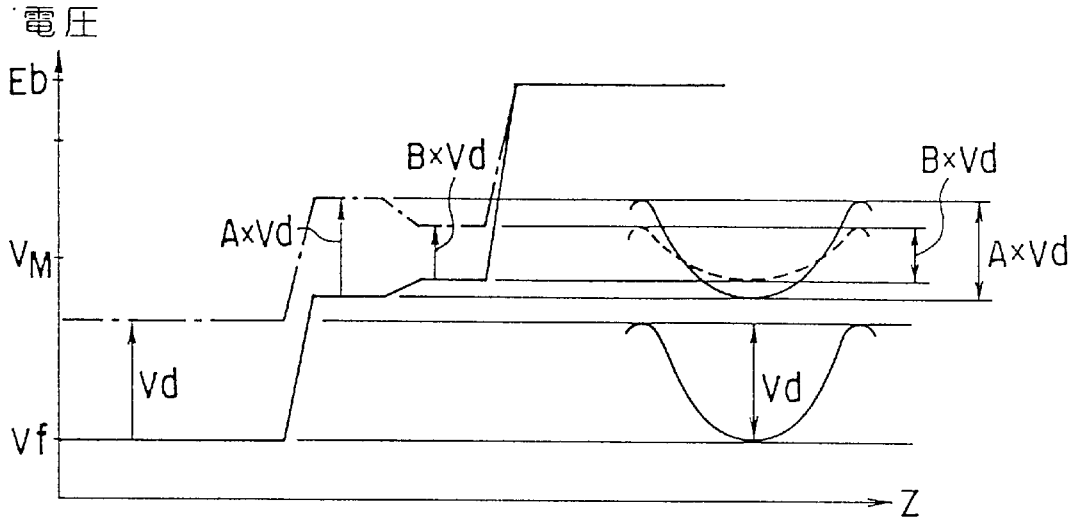
FIG. 10 is a graph representing the voltages applied to the electrodes of FIG. 9, and changes in the voltages.
Figure 11:
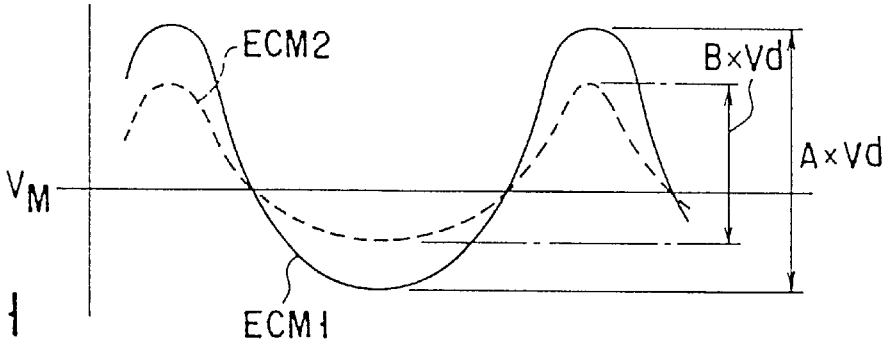
FIG. 11 is a graph showing the waveforms of the voltages applied to the electrodes shown in FIG. 9.
Figure 12:
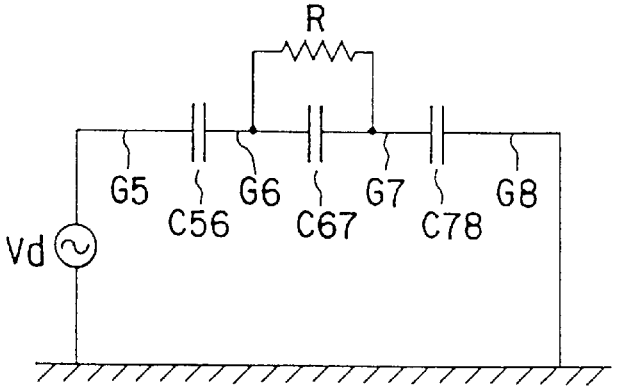
FIG. 12 is a diagram showing an AC equivalent circuit of the electrodes shown in FIG. 9.

FIG. 9 is a schematic representation of the main electron lens sections 5 to 8 of the first embodiment of this invention. FIG. 10 shows the voltage applied to the electrode shown in FIG. 9. In FIG. 10, the solid line represents the voltage distribution that is observed when the electron beam is directed at the center of the screen. The one-dot dashed line indicates the voltage distribution that is observed when the electron beam is directed at a peripheral region of the screen. A dynamic voltage Vd, distributed as shown by a parabola-like curve, is applied to the fifth grid 5 as reference voltage Vf. The anode voltage Eb is applied to the eighth grid 8. The resistor 100 provided inside the cathode-ray tube divides the anode voltage Eb into voltages. These voltages, voltages VM, are applied to the sixth and seventh grids 6 and 7 that are provided between the fifth and eighth grids 5 and 8. The voltage VM is intermediate between the focusing voltage Vf applied to the fifth grid 5 and the voltage Eb applied to the eighth grid 8. With the middle voltage VM used as a reference, the inter-electrode capacitance C56 between the fifth and sixth grids 5 and 6, inter-electrode capacitance C67 between the sixth and seventh grids 6 and 7, and inter-electrode capacitance C78 between the seventh and eighth grids 7 and 8 divides the parabola-like dynamic voltage Vd in synchronism with the deflecting magnetic field applied to the fifth grid 5. As shown in FIG. 11, an AC current A×Vd is supplied to the sixth grid 6, and an AC current B×Vd is supplied to the seventh grid 7. Values A and B are determined in the following way by solving the equivalent AC circuit shown in FIG. 12.

Voltage A×Vd:

$$A = C56 \cdot (C78 + C67) / (C56 \cdot C67 + C67 \cdot C78 + C78 \cdot C56)$$

Voltage B×Vdb (AC component):

$$C56 \cdot C67 / (C56 \cdot C67 + C67 \cdot C78 + C78 \cdot C56)$$

Thus, the dynamic voltage Vd is applied to the fifth grid 5, the superimposed voltage (A×Vd) is applied to the sixth grid 6, and the superimposed voltage (B×Vd) is applied to the seventh grid 7. In other words, voltages that change in synchronism with the deflecting magnetic field as shown in FIG. 11 are applied to the sixth and seventh grids 6 and 7. The action of any electric field lens between two grids changes in synchronism with the deflecting magnetic field.

Figure 6:
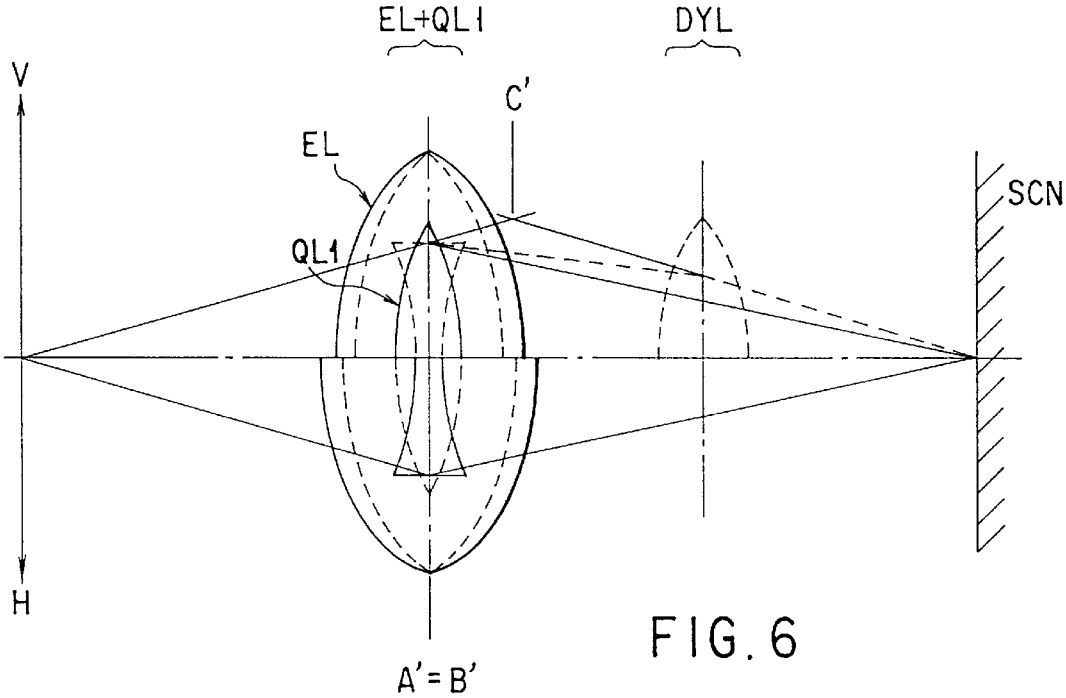
FIG. 6 is a diagram illustrating the operation of the electron lens used in the electron gun assembly incorporated in a cathode-ray tube according to an embodiment of this invention.

The main electron lens EL performs the lens power shown in FIG. 6. As shown in FIG. 6, the multiple lens QL1 is provided near the center of the main electron lens EL. When the electron beam is deflected from the center of the screen toward a peripheral region of the screen, the dynamic voltage Vd is applied to the fifth grid 5. An electric field expansion-type main electron lens EL is formed, extending from a first lens region lying between the fifth and sixth grids 5 and 6 to a third lens region formed between the seventh and eighth grids 7 and 8. The power of the main electron lens EL is reduced, from the solid line to the broken line. Furthermore, the action of a multiple lens, for example, four-pole lens QL1 formed in a second lens region between the sixth and seventh grids 6 and 7 is changed. This is because the AC voltage of A×Vd superimposed on the sixth grid 6 differs from the AC voltage of B×Vd superimposed on the seventh grid 7, as illustrated in FIG. 6. When the electron beam is directed at the center of the screen, the lens QL1 diverges electron beams in the horizontal direction and focuses them in the vertical direction, as indicated by the solid line. When the electron beam is deflected to a peripheral region of the screen, the lens QL2 focuses the electron beams in the horizontal direction and diverges then in the vertical direction, as is illustrated by the broken line. Due to these changes in the lens power, the horizontal lens power of the main electron lens EL and the horizontal lens power of the multiple lens QL1 cancel each other out. The overall horizontal focusing power of the entire main lens unit (first, second and third lens regions) is substantially preserved.

Figure 1:
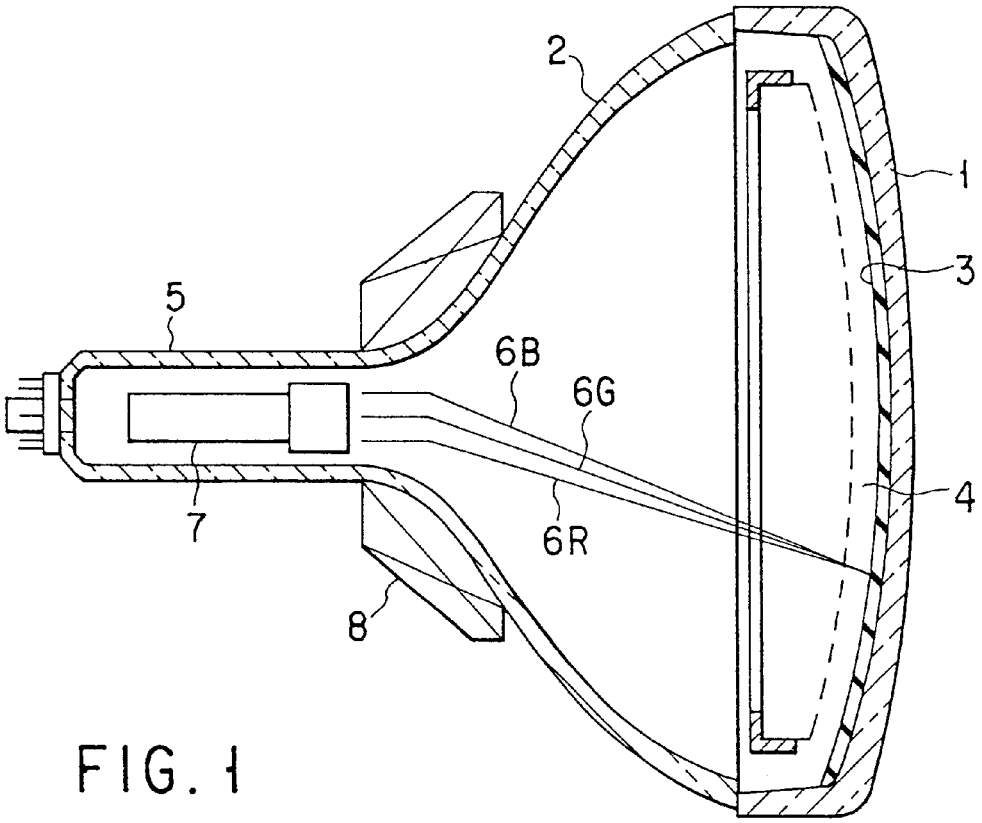
FIG. 1 is a schematic cross-sectional view of a conventional cathode-ray tube.
Figure 2A:
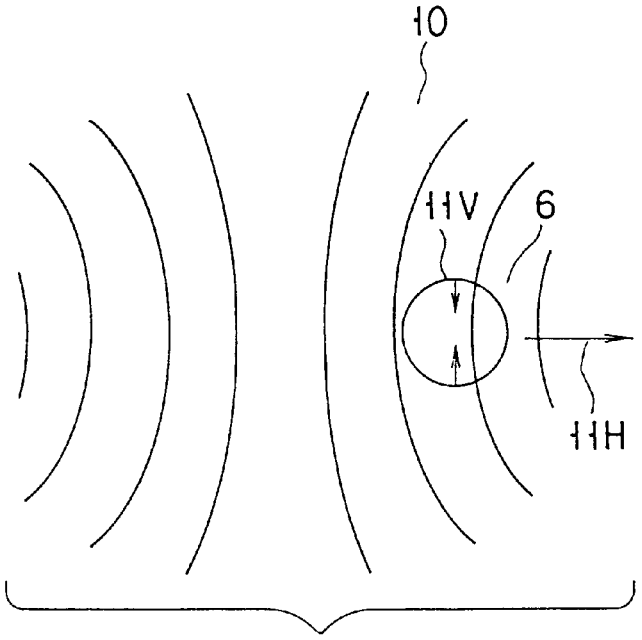
FIGS. 2A and 2B are diagrams explaining how a beam spot expands sideways due to a pincushion-shaped deflecting magnetic field.
Figure 2B:
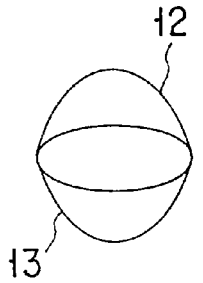
Figure 3:
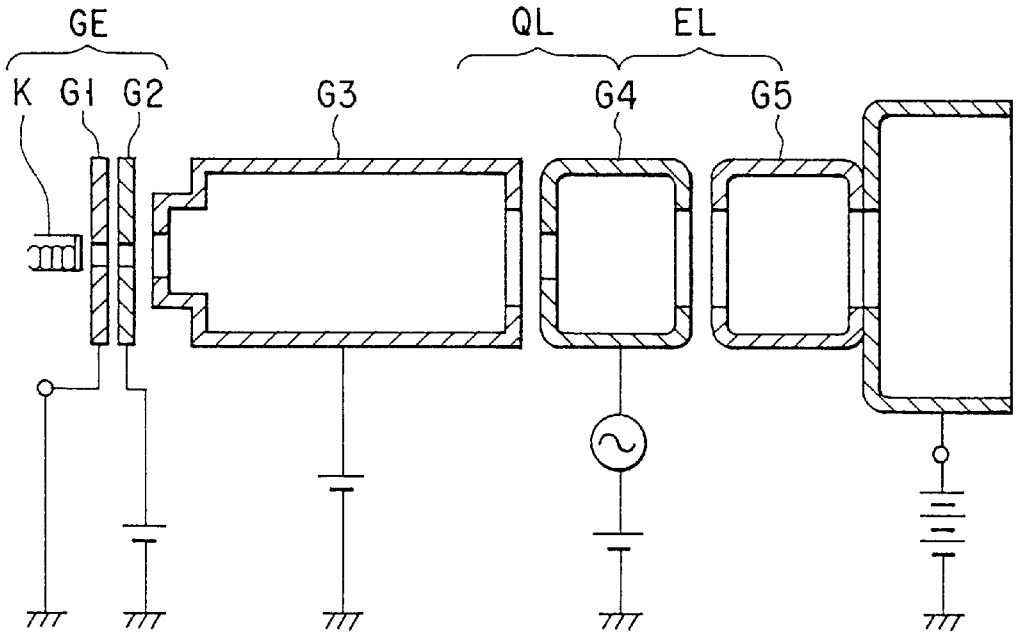
FIG. 3 is a diagram showing the conventional electron gun assembly and peripheral circuits, all incorporated in the associated with the gun assembly.
Figure 4A:
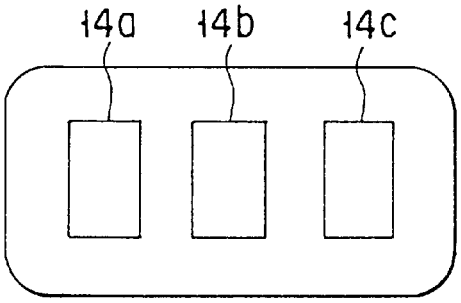
FIGS. 4A and 4B are plan views depicting the shapes of the electrodes incorporated in the electron gun assembly shown in FIG. 1.
Figure 4B:
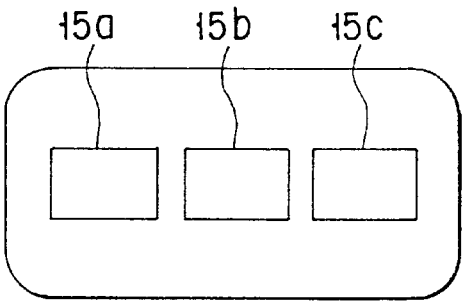
Figure 5:
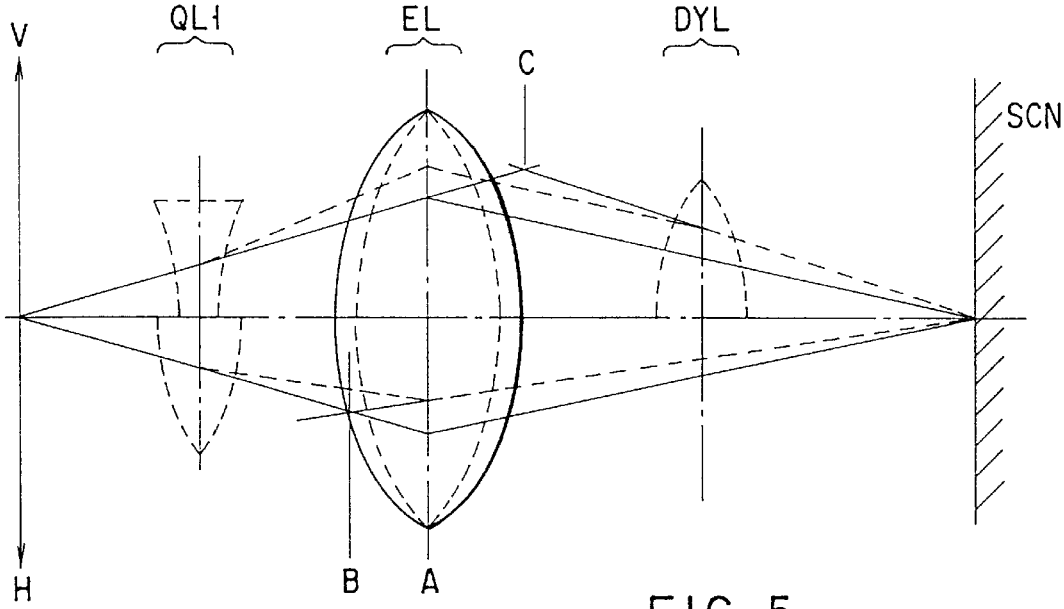
FIG. 5 is a diagram illustrating the lens operation performed in the electron gun assembly provided in the conventional cathode-ray tube shown in FIG. 1.

At this time, the electron beam travels along the track shown by the broken lines, in the vertical direction. multiple lens The horizontal track of the electron beam is the same as in the case where the electron beam is focused in the center of the screen, because the four-pole electron lens QL1 is arranged in the main electron lens El at the same position. In the vertical direction, the main plane of the lens which focuses the electron beam in the horizontal direction (H) does not change, whether the electron beam is in the center of the screen or deflected to the peripheral region of the screen (main plane A'=main plane B'). (The main plane of the lens is hypothetically the center of the lens, a point where the emitted beam track and the incident beam track cross each other.) The main plane moves forward by a distance equal to the thickness of the deflecting lens DYL. In the conventional electron gun assembly, the multiple lens QL1 is positioned between the cathode and the main electron lens as shown in FIG. 5, the multiple lens diverges the electron beam in the vertical direction, the electron beam track passes a point at some distance from the axis of the main electron lens, and the main plane of the lens moves from the position C forward. In electron gun assembly of this invention, the track of the electron beam incident to the main electron lens EL remains unchanged since the multiple lens is provided inside the main electron lens EL. As a result, the main plane moves in the vertical direction to position C', which is closer to the cathode than the position C the main plane takes in the conventional electron gun assembly. The magnification in the vertical direction is not greater than in the conventional electron gun assembly, and the vertical diameter of the electron beam is not greatly decreased at the peripheral region of the screen. Therefore, the position of the main plane has a smaller little deviation in the horizontal and vertical directions than in the conventional electron gun assembly. Hence, in any peripheral region of the screen, the magnification in the vertical direction is not good and the magnification in the horizontal direction is not bad. The sideways deviation of the electron beam at the peripheral region of the screen is reduced, whereby a more round beam spot can be formed. The electron gun assembly according to the invention therefore serves to provide a cathode-ray tube in which no sideways deviation of electron beams occurs in the peripheral regions of the screen and higher image resolution is achieved in all regions of the screen.

Moreover, the sixth grid 6 and the seventh grid 7 are connected by the resistor 100 provided near the electron gun assembly. The sixth and seventh grids 6 and 7 are provided between the fifth grid 5 and the eighth grid 8. An AC voltage in synchronism with the deflecting magnetic field is applied to the fifth grid 5, and a DC anode voltage is applied to the eighth grid 8. Therefore, the AC voltage applied to the fifth grid 5 can be applied to the sixth and seventh grid 6 and 7 via the static capacitances C56, C67 and C78 which are provided between the fifth to eighth grids 5 to 8. The multiple lens formed among these grids can operate, by virtue of the potential difference generated between the sixth and seventh grids 6 and 7. Furthermore, the resistor 100 provided near the electron gun assembly divides the anode voltage Eb applied to the eighth grid 8, into voltages. These voltages are applied to the sixth and seventh grids 6 and 7, respectively. An extra voltage need not be applied from outside the cathode-ray tube. This makes it easy to provide a high-quality cathode-ray tube.

The present invention is not limited to the first embodiment described above. For instance in the first embodiment, the main electron lens EL provided in the first and third lens regions and the multiple lens QL provided in the second and fourth lens regions preserve their actions in the horizontal direction when the electron beam is deflected from the center of the screen to the peripheral region of the screen. Needless to say, these two lenses (EL and QL) may operate in mutually opposite directions, to reduce the sideways deviation of the electron beam spot at any peripheral region of the screen, unlike in the conventional electron gun assembly.

Figure 13A:
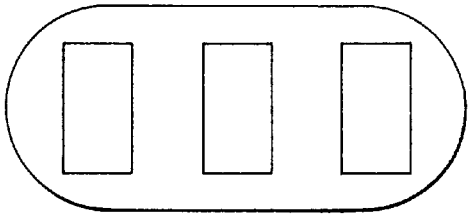
FIGS. 13A to 13D are plan views showing the shapes of replacement electrode that may be used in the electron gun assembly shown in FIGS. 7A and 7B.
Figure 13B:
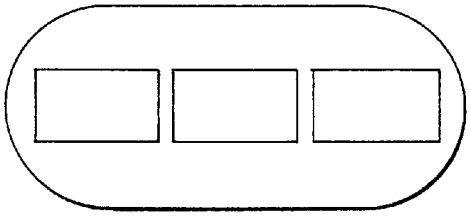
Figure 14A:
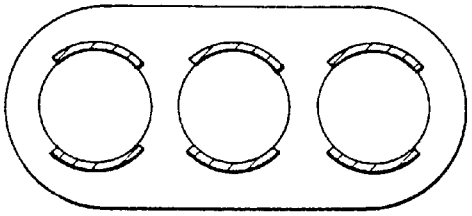
FIGS. 14A and 14B are plan views of the shapes of other replacement electrodes that may be used in the electron gun assembly shown in FIGS. 7A and 7B.
Figure 14B:
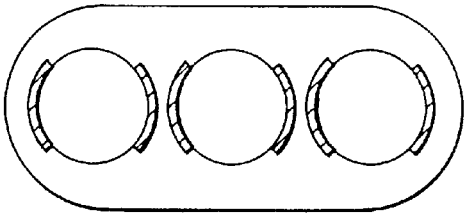

Furthermore, in the first embodiment, the multiple lens provided between the sixth and seventh grids has Peak-shaped electrodes provided above and below and on the left and right of the electron beam guide holes. Instead, the multiple lens may have holes horizontally elongated and holes vertically elongated, as is shown in FIGS. 13A and 13B. Alternatively, the multiple lens may have Peak-shaped electrodes provided above and below and on the left and right of the circular arc, as is illustrated in FIGS. 14A and 14B. Any other structure in which a difference exists between the lens power in the horizontal direction and the lens power in the vertical direction. The greater the lens power, the better.

Figure 13C:
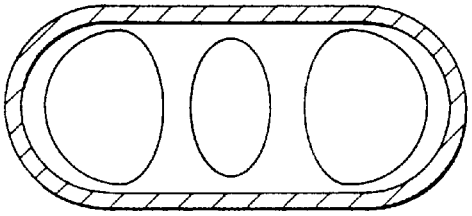

Furthermore, the electron beam guide holes made in the fifth and eighth grids 5 and 8 are not limited to one described above. As shown in FIG. 13C for instance, the center beam guide hole may have a vertically elongated oval shape, and the side beam guide holes may be shaped like a rounded triangle. Is shaped so, the beam guide holes serve to reduce the coma aberration which the cylindrical electrode impose on the side electron beans.

Figure 13D:
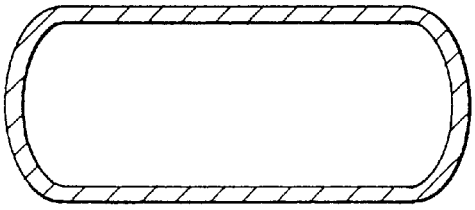
Figure 15:
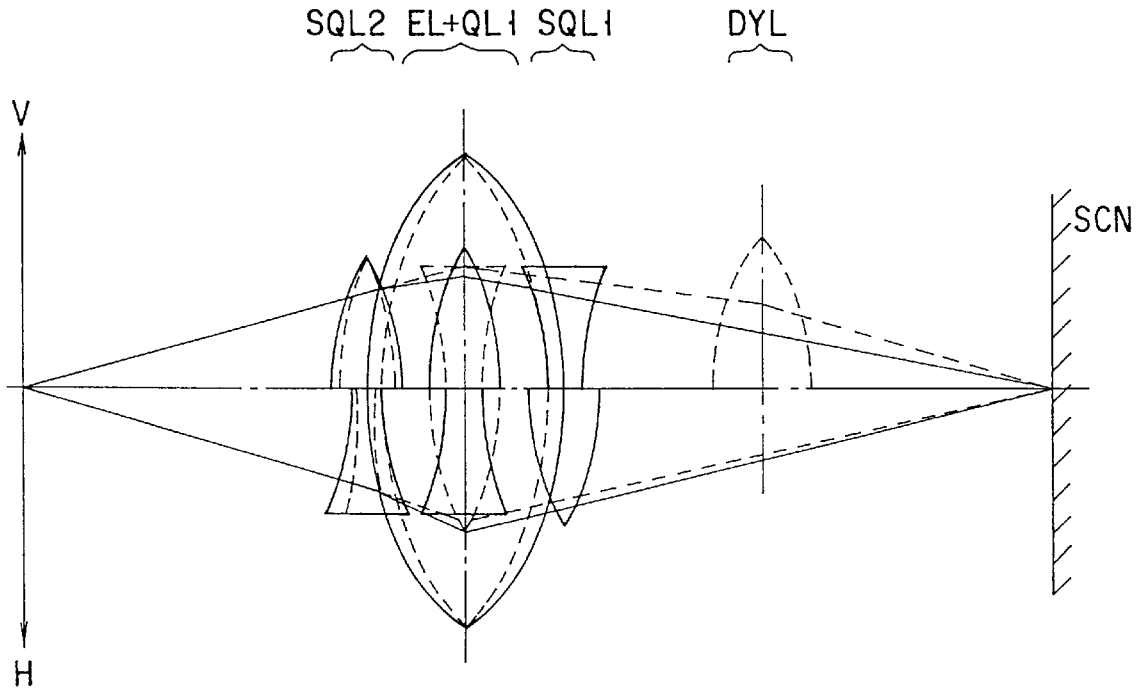
FIG. 15 is a diagram illustrating the operation of the electron lens used in the electron gun assembly that is incorporated in a cathode-ray tube according o another embodiment of the invention.
Figure 16A:
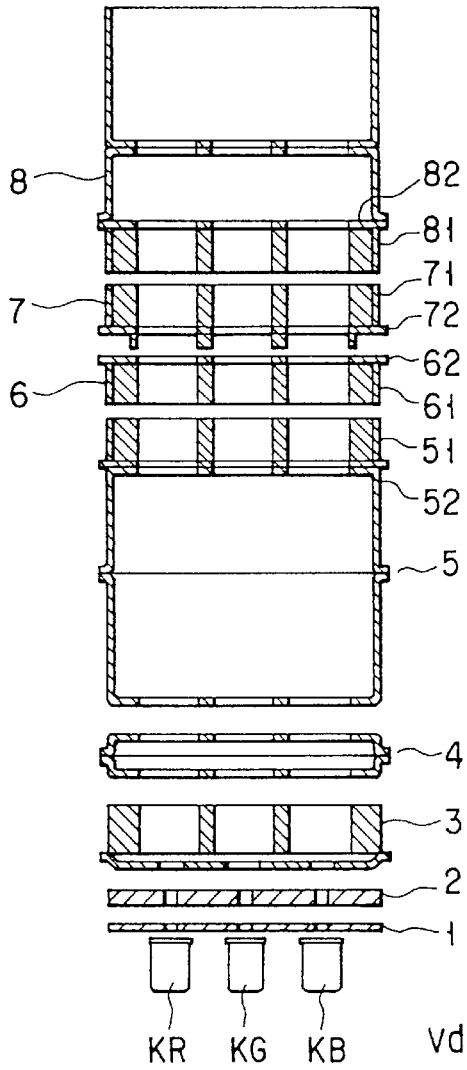
FIGS. 16A and 16B are cross-sectional views of the electron gun assembly incorporated in a cathode-ray tube which is still another embodiment of the invention.
Figure 16B:
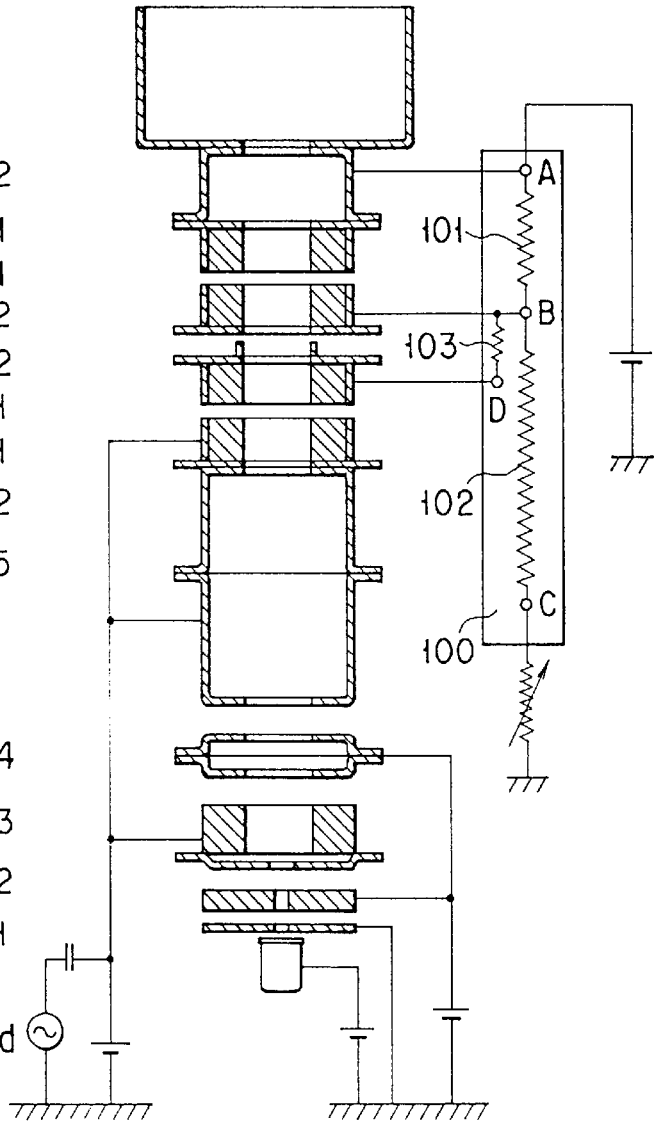

Moreover, the cylindrical electrode of the present invention is not limited to the one described above. The cylindrical electrode may have a rectangular cross section, as shown in FIG. 13D. Further, the structure of the main electron lens is not limited to the above-described one. As shown in FIG. 15, four-pole components (SQL1 and SQL2) may be provided on either side of the main electron lens (EL+QL1) of FIG. 6. In this case, too, the same advantages can be attained. The electrodes forming the opposing faces of the electrodes constituting the main electron lens are not limited to cylindrical ones. Rather, thick-plate electrodes, each having electron beam guide holes, may be used instead as shown in FIGS. 16A and 16B, thereby to achieve the same advantages as described above.

Figure 17A:
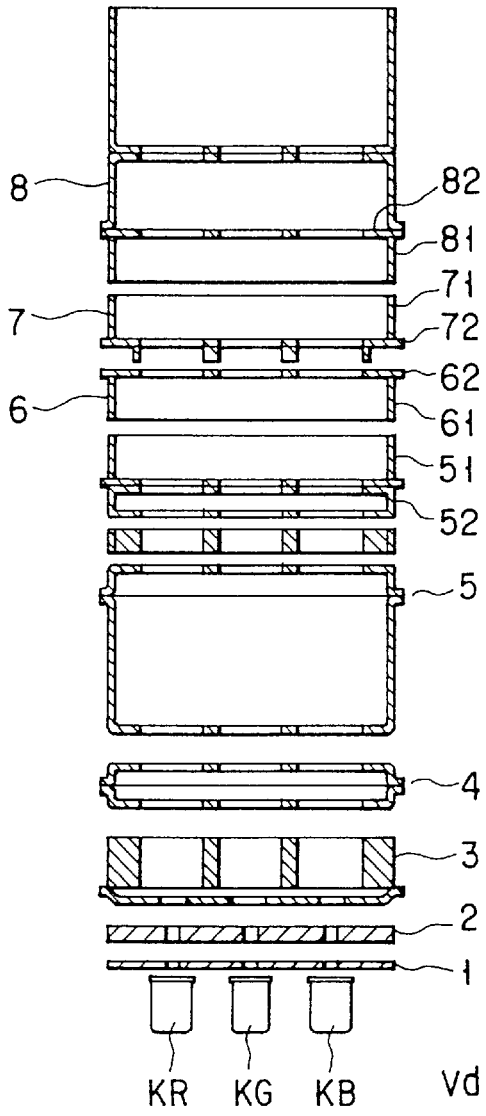
FIGS. 17A and 17B are cross-sectional views of the electron gun assembly provided in a cathode-ray tube according to another embodiment of the invention.
Figure 17B:
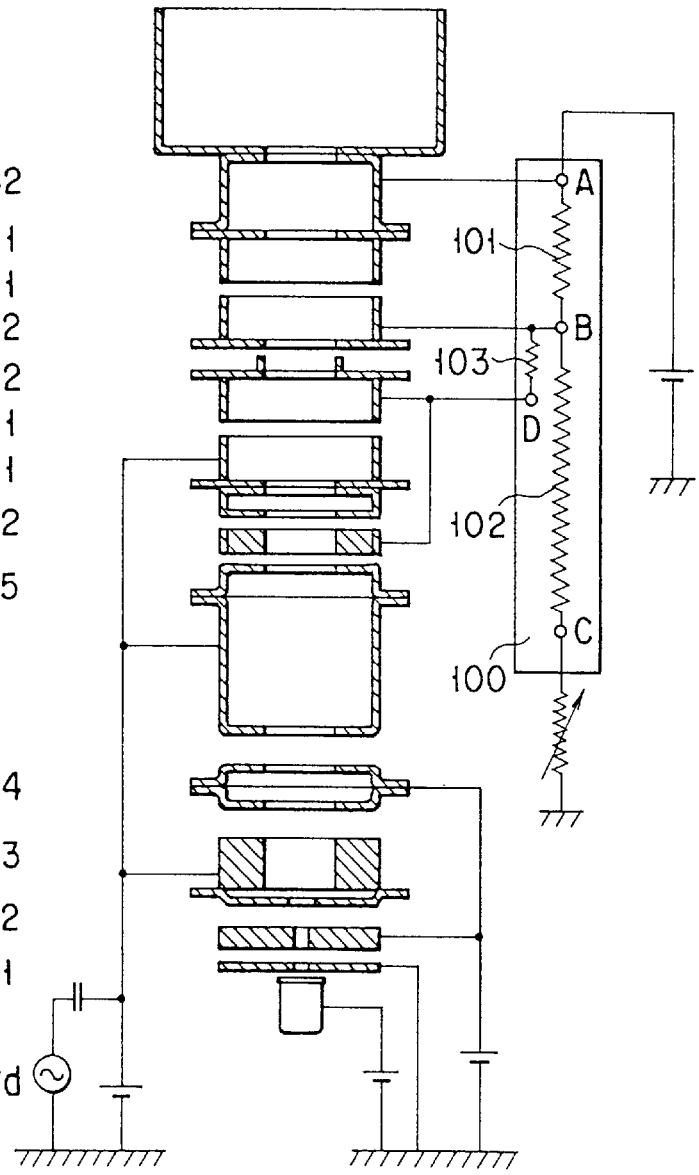

In the first embodiment, the rates A and B at which the voltages are superimposed on the sixth grid 6 and the seventh grid 7 are about 0.6 and 0.3, respectively. The voltage for operating the multiple lens between the sixth grid 6 and the seventh grid 7 is 0.3 Vd. As shown in FIG. 17, the fifth grid 5 may be divided into two parts and a ninth electrode may be inserted between these electrodes and connected to the sixth electrode. In this case, the superimposition rates A and B can be increased to 0.8 and 0.4, whereby the multiple lens between the sixth grid 6 and the seventh grid 7 can operate at 0.4 Vd. Hence, the multiple lens is more powerful, further reducing the sideways deviation of the beam spot at any peripheral region of the screen.

INDUSTRIAL APPLICABILITY

As already explained, a cathode ray tube comprising an electron beam formation portion for forming and emitting at least one electron beam; an electron gun assembly having a main electron lens section for accelerating and high-speed focusing this electron beam; and a deflecting yoke for generating a deflecting magnetic field for deflect-scanning the electron beam emitted from this electron gun assembly in the horizontal and vertical directions on a screen; the cathode ray tube having a structure wherein the main electron lens section comprises multiple electrodes containing at least a first grid 1 to which a middle voltage is applied and a fourth grid 4 to which an anode voltage is applied, and at least two adjacent grids, being a second grid 2 and third grid 3, connected by a resistor, to which are applied voltages of roughly the same potential which are higher than the middle voltage and lower than the anode voltage, sequentially provided between these two electrodes, a first lens region being formed the first grid 1 and the second grid 2, a third lens region being formed between the third grid 3 and the fourth grid 4, and having means for forming an asymmetrical lens in the second lens region between the adjacent second grid 2 and the third grid 3, the lens power of at least this asymmetrical lens provided in the second lens region. The action of the main electron lens comprises the first, second and third lens regions changes in synchronism with the deflecting magnetic field. As the electron beam is directed from the center of the screen toward a peripheral region of the screen due to the deflecting magnetic field, the focusing powers of the first and third lens regions of the main electron lens section are weakened in the horizontal and vertical directions. When the electron beam is deflected from the center region of the screen to the peripheral region of the screen, the asymmetrical lens provided in the second lens region has a relatively large focusing power in the horizontal direction and a relatively large diverging power in the vertical direction. Furthermore, a voltage changing in synchronism with the deflecting magnetic field is applied to the first grid. As the electron beam is directed from the center region of the screen toward the peripheral region of the screen, in synchronism with the deflecting magnetic field, the first and third lens regions performs an action, which is weak in the horizontal and the vertical directions. By contrast, the asymmetrical lens provided in the second lens region focuses an electron beam in the horizontal direction and diverges the electron beam in the vertical direction. Overall changes of the lens power in the horizontal direction of the first and third lens regions are canceled out. Moreover, an AC voltage which changes in synchronism with the deflecting magnetic field to the first grid, the AC voltage components thereof, are applied via static capacitors between the first to fourth grids to the second grid and the third grid. The lens power of the first, second and third lens regions are thereby changed.

In the structure described above, the multiple lens (QL) is positioned near the center of the main electron lens (EL). Since the position of the multiple lens roughly matches the position of the main electron lens, the main lens plane in the horizontal direction of the electron beam deflected to the peripheral region of the screen (hypothetically the lens center, or the point at which the emitted beam track crosses the beam track incident to the screen) does not move from the position it takes when the electron beam is in the center of the screen. The main lens plane is less deviated in the horizontal and vertical directions at any peripheral region of the screen, than in the conventional electron gun assembly. The sideways deviation of the electron beam at the peripheral region of the screen is reduced proportionally. Hence, a more rounded electron beam is applied to the peripheral region of the screen.

Moreover, the second grid and the third grid are connected at a resistor provided near the electron gun assembly. The second grid and the third grid are provided between the first grid and the fourth grid. An AC voltage is applied to the first grid in synchronism with the deflecting magnetic field. A DC anode voltage is applied to the fourth grid. The component of the AC voltage applied to the first grid can therefore be applied to the second grid and the third grid via the static capacitors provided between the first to fourth grids. The multiple lens formed between these electrodes can operate, by virtue of the potential difference between the second grid and the third grid generated at this time.

Moreover, the resistor provided near the electron gun assembly divides the anode voltage applied to the fourth grid, into voltages. These voltages are applied to the second grid and the third grid. Thus, an extra voltage need not be applied from outside the cathode-ray tube. A high-quality cathode ray tube can therefore be provided, which is considerably significant from an industrial point of view.

What is claimed is:

1. A cathode ray tube comprising:

an electron beam formation portion for forming and emitting at least one electron beam;

an electron gun assembly having a main electron lens section for accelerating and focusing the electron beam; and a deflecting yoke for generating a deflecting magnetic field for deflecting the electron beam emitted from the electron gun assembly in the horizontal and vertical directions on a screen; wherein the main electron lens section comprises first, second, third and fourth grids, a middle first voltage being applied to the first grid, an anode voltage being applied to the fourth grid, the adjacent second grid and the third grid being connected by a resistor, second and third voltages of substantially the same potential, corresponding to voltages higher than the first voltage and lower than the anode voltage, being applied to the second and third grids; a first lens region being formed between the first grid and the second grid; a third lens region being formed between the third grid and the fourth grid; a second lens region being formed between the second grid and the third grid; and an asymmetrical lens being provided in this second lens region.

2. A cathode ray tube according to claim 1, wherein the lens powers of the first, second and third lens regions are changed in synchronism with the deflecting magnetic field.

3. A cathode ray tube according to claim 1, wherein the first and third lens regions have a lens power which weakens in the horizontal and the vertical directions, and by contrast, the asymmetrical lens provided in the second lens region has a lens power of relatively focusing in the horizontal direction and diverging in the vertical direction.

4. A cathode ray tube according to claim 1, wherein a voltage which changes in synchronism with the deflecting magnetic field is applied to the first grid, and as the electron beam is directed from the center portion of the screen toward the peripheral region of the screen in synchronism with the deflecting magnetic field, the first and third lens regions have a lens power which weakens in the horizontal and the vertical directions, and by contrast, the asymmetrical lens provided in the second lens region has a lens power of relatively focusing in the horizontal direction and diverging in the vertical direction.

5. A cathode ray tube according to claim 1, wherein as the electron beam is directed from the center portion of the screen toward the peripheral region of the screen in synchronism with the deflecting magnetic field, the first and third lens regions have a lens power which weakens in the horizontal and the vertical directions, and by contrast, the asymmetrical lens provided in the second lens region has a lens power of relatively focusing in the horizontal direction and diverging in the vertical direction; and wherein changes in the overall horizontal direction lens power of the lens power of the third lens region are canceled.

6. The cathode ray tube according to claim 1, wherein by applying an AC voltage which changes in synchronism with the deflecting magnetic field to the first grid, the AC voltage components thereof are applied via static capacitances between the first grid, the second grid, the third grid and the fourth grid to the second grid and the third grid, changing the lens power of the first, second and third lens regions.

7. A cathode ray tube according to claim 1, wherein the second and third grids are connected together through a resistor, and the anode voltage applied to the fourth grid is applied to the second and third grids through one of terminals of the resistor.

8. The cathode ray tube comprising:

an electron beam formation portion for forming and emitting at least one electron beam;

an electron gun assembly having a main electron lens section for accelerating and focusing the electron beam; and a deflecting yoke for generating a deflecting magnetic field for deflecting the electron beam emitted from this electron gun assembly in the horizontal and vertical directions on a screen; wherein the main electron lens section comprises first, second, third and fourth grids, a middle first voltage is applied to the first grid, an anode voltage is applied to the fourth grid, second and third grids are connected by a resistor, second and third voltages are applied to the second and third grids, the second and third voltages are higher than the first voltage and lower than the anode voltage, the first grid and second grid are closely arranged, the first voltage is varied in synchronous with the deflection magnetic field, the second grid is electrically connected to fifth grid, and fifth grid is so arranged as to closed to the first grid or the other grid, to which fifth voltage being varied with the deflection magnetic field is applied.

9. A cathode ray tube according to claim 8, wherein the second and third grids are connected together through a resistor, and the anode voltage applied to the fourth grid is applied to the second and third grids through one of terminals of the resistor.

10. A cathode ray tube comprising at least:

an electron beam formation portion for forming and emitting at least one electron beam;

an electron gun assembly having a main electron lens section for accelerating and focusing the electron beam; and a deflecting yoke for generating a deflecting magnetic field for deflecting the electron beam emitted from the electron gun assembly in the horizontal and vertical directions on a screen; wherein the electron lens section comprises a plurality of electrodes including a first grid to which an intermediate voltage is applied and a fourth grid to which an anode voltage is applied, and at least a second grid and a third grid, which are adjacent to each other, are arranged in series between the two electrodes, the second and third grids are connected together through a resistor, and voltages obtained by resistance-dividing the anode voltage applied to the fourth grid are applied to the second and third grids through one of terminals of the resistor.

* * * * *